United States Patent [19]

Larkey

[11] Patent Number: 4,737,163

[45] Date of Patent: Apr. 12, 1988

[54] COATED ABRASIVE PRODUCT INCORPORATING SELECTIVE MINERAL SUBSTITUTION

[75] Inventor: Thomas W. Larkey, Hugo, Minn.

[73] Assignee: Minnesota Mining and Manufacturing Company, St. Paul, Minn.

[21] Appl. No.: 921,944

[22] Filed: Oct. 20, 1986

Related U.S. Application Data

[63] Continuation-in-part of Ser. No. 721,905, Apr. 10, 1985, abandoned, which is a continuation-in-part of Ser. No. 608,481, May 9, 1984, abandoned.

[51] Int. Cl.[4] ..... B04D 11/00

[52] U.S. Cl. ..... 51/295; 51/298; 51/309

[58] Field of Search ..... 51/295, 309, 298

[56] References Cited

U.S. PATENT DOCUMENTS

| | | | |
|---|---|---|---|
| 1,616,531 | 2/1927 | King | 51/298 |
| 2,410,506 | 11/1946 | Kirchner et al. | 51/188 |
| 2,970,929 | 2/1961 | Hansen et al. | 117/17 |
| 3,181,939 | 5/1965 | Marshall et al. | 51/209 |
| 3,205,054 | 9/1965 | Tucker et al. | 51/298 |
| 3,266,878 | 8/1966 | Timmer | 51/298 |
| 3,806,956 | 4/1974 | Supkis et al. | 51/295 |
| 3,867,795 | 1/1975 | Howard | 51/209 |
| 3,891,408 | 6/1975 | Rowse et al. | 51/295 |
| 3,893,826 | 7/1975 | Quinan et al. | 51/295 |
| 3,996,702 | 12/1976 | Leahy | 51/295 |
| 4,038,046 | 7/1977 | Supkis | 51/295 |
| 4,314,272 | 2/1982 | Leitheiser et al. | 51/298 |

*Primary Examiner*—Paul Lieberman
*Assistant Examiner*—Willie J. Thompson
*Attorney, Agent, or Firm*—Donald M. Sell; James A. Smith; Richard E. Brink

[57] ABSTRACT

Replacement of all or most of the coarse mineral in a coated abrasive product by a superior (and typically more expensive) mineral improves abrading performance significantly more than would be predicted. In some cases the performance is superior to that of products made with either mineral alone. The mineral is typically applied in two layers, substantially all of the coarse mineral being applied in the second layer. Superiority is defined in terms of a test that measures the comparative ability of different minerals to abrade cold rolled steel.

13 Claims, No Drawings

COATED ABRASIVE PRODUCT INCORPORATING SELECTIVE MINERAL SUBSTITUTION

CROSS-REFERENCE TO RELATED CASE

This application is a continuation-in-part of application Ser. No. 721,905, filed Apr. 10, 1985, abandoned, which in turn is a continuation-in-part of Ser. No. 608,481, filed May 9, 1984, and now abandoned.

BACKGROUND OF THE INVENTION

This invention relates to coated abrasive products and is especially concerned with coated abrasive products using two or more different abrasive minerals.

The minerals used in coated abrasive products made in the United States of America conventionally meets American National Standards Institute, Inc. (ANSI) standards, which specify that the particle size distribution for each nominal grade falls within numerically defined limits. According to the ANSI standards, any nominal grade is made up of three particle size fractions, viz., a "control" fraction, an "overgrade" fraction containing large particles nominally one fraction coarser than the control fraction, and a "fine" fraction containing small particles finer than the control fraction. Additionally, ANSI standards permit the inclusion of up to 0.5% particles coarser than the overgrade fraction. The percentage of particles falling within each fraction varies from grade to grade; in general, however, about 50–60% are in the control fraction, about 10% in the overgrade fraction and about 30–40% in the fine fraction. When considered as a total, the sum of the three fractions is referred to as "full grade".

As used in the preceding paragraph, the term "grade" refers to a specified combination of abrasive particles as related to the standard mesh screens through which the particles will or will not pass. To illustrate, ANSI Publication B74.18-1977 provides that a coated abrasive product having a nominal Grade 50 mineral coat will contain a control fraction that will pass through a 48.5-mesh (1 Std.) screen but not through a 58.5-mesh (3 Std.) screen, an overgrade fraction that will pass through a 37-mesh (38GG) screen but not a 48.5-mesh (1 Std.) screen, and a fine fraction that will pass through a 58.5-mesh (3 Std.) screen. Additionally, Grade 50 may include up to 0.5% of extra-coarse particles that pass through a 32-mesh (32GG) but not through a 38-mesh (38GG) screen. The term "mesh" refers to the number of openings per lineal inch in the screen. Grading systems employed in foreign countries also utilize screens but vary somewhat as to the exact particle size, the number of screens, and the percentage of particles falling in the several fractions that collectively make up a "full grade". Like the ANSI system, the Japanese grading system employs three fractions; the European grading system effectively includes four fractions, the coarsest three of which correspond roughly to the ANSI overgrade and control fractions. As a point of interest, the various grading systems are all intended to provide complete utilization of all the particles obtained during the process of crushing the originally supplied lumps of raw abrasive mineral.

For any given abrading operation, some types of abrasive mineral are more effective than others. For most metal abrading operations, however, the most widely used mineral has long been fused aluminum oxide, or alumina. In recent years, superior minerals have been developed by the co-fusion of alumina and zirconia; see, e.g., U.S. Pat. Nos. 3,181,939, 3,891,408, and 3,893,826. Another recently developed superior mineral, described in U.S. Pat. No. 4,314,827, is a non-fused synthetic alumina-based ceramic containing certain metal oxide and/or spinel additives. Both the co-fused alumina-zironia and the non-fused ceramic products are significantly more expensive than the conventional fused alumina, as, of course, are the coated abrasive products made with such minerals. Other slightly superior—and comparatively expensive—alumina-based minerals may be obtained by specially heat treating or coating conventional fused alumina.

It has been suggested that various types of minerals can be blended in making coated abrasive products; see, e.g., U.S. Pat. No. 3,205,054. One commercial product embodying this concept incorporates a full-grade blend of conventional fused alumina and the significantly more expensive co-fused alumina:zirconia. See also U.S. Pat. Nos. 3,410,506 and 3,266,878, showing the use of inexpensive "diluent" grain blended with diamond particles of the same grade. U.S. Pat. No. 3,996,702 describes the blending of co-fused alunina:zirconia with flint, garnet, or fused alumina of the same grade, and U.S. Pat. No. 4,314,827 suggests blending non-fused alumina based abrasive grain with conventional fused alumina of the same grade.

Previous workers have made coated abrasive products by a process in which the same type of abrasive grain was applied in two separate layers see, e.g., U.S. Pat. No. 2,970,929, showing the application of the mineral by drop coating the first layer and electrostatically coating the second. Prior to the present invention others have also applied a first mineral coat that is a full grade of one type of mineral (conventional fused alumina) and a second coat that is a full grade of a relatively superior second type of mineral (co-fused alumina:zirconia), achieving an abrading performance substantially equal to a conventional product in which a single coat of full grade superior mineral was applied. In the manufacture of molded fabric-reinforced abrasive grinding wheels, several combinations of abrasive grain have been suggested for use in different layers of the construction. For example, U.S. Pat. No. 1,616,531 describes the use of different particle size mineral in the various abrasive layers. U.S. Pat. No. 3,867,795 describes the blending of expensive co-fused alumina:zirconia with flint, emery, silicon carbide, fused alumina, etc. in the various layers of relatively thin snagging wheels for use on portable grinders. One suggested construction in the latter patent utilizes conventional fused alumina in one layer with a blend of co-fused alumina:zirconia and a coarser garnet in the work-contacting surface.

Although products of the type described in the preceding paragraphs have managed to reduce the overall cost of the mineral applied in the coated abrasive construction, there has remained a strong desire to utilize the superior mineral more efficiently, so as to maximize the benefits obtained from its use.

BRIEF DESCRIPTION OF THE INVENTION

The present invention provides coated abrasive products having excellent abrading effectiveness, utilizing the advantages inherent in superior abrasive grains while minimizing the quantity of such grains actually present. Indeed, in some instances synergistic effects are obtained, the construction actually performing better than coated abrasive products in which only the superior mineral is present.

The present invention combines a minor portion of superior abrasive grains in the balance, correspondingly constituting a major portion of inferior abrasive grains in such a way that most of the inferior grain is concentrated in the finer portions. The unexpectedly good performance contributed by the superior grain can sometimes be detected in quantities as low as 1% by weight, but 3% of the superior grain contributes more consistently significant improvement. For most purposes, the superior abrasive grain will constitute 5% to 30% (preferably 10% to 20%) of the total mineral weight. It is technically feasible to add up to 50% of the superior grain if the increased performance of the product offsets the additional cost. Thus, the invention can be broadly characterized as a coated abrasive product having a specified nominal grade of abrasive granules firmly adherently bonded to a sheet backing, the particle size of the granules ranging from fine to coarse and comprising a control fraction, an overgrade fraction containing particles coarser than the control fraction, and a fine fraction containing particles finer than the control fraction. The granules consist essentially of two types of mineral, one type being at least demonstrably superior to an equivalent grade of the other type in the abrading operation for which the coated abrasive product is intended to be used. The abrasive granules are present in at least two layers, the lower layer or layers containing substantially only fine and control fractions of the inferior mineral. The outermost layer consists essentially of (a) particles from the overgrade fraction of superior mineral, (b) particles from the fine fraction of at least one of the types of mineral, and (c) particles from the control fraction of at least one of the types of minerals.

As will be shown, products corresponding to the invention can be made by a multiple coating operation in which the first mineral coat does not conform to conventional mineral grading specifications because it exceeds the limits for fine particles, and the second mineral coat does not conform to conventional mineral grading specifications because it exceeds the limits for coarse particles. In this construction, the coarse fraction, which consists essentially of the superior mineral, is present in the second coat. The overall composition of the two mineral layers is, however, in full compliance with mineral grading specifications.

DESCRIPTION OF PRESENTLY PREFERRED EMBODIMENTS

Although the terms "superior" and "inferior" might seem to involve a considerable degree of subjectivity, those skilled in the coated abrasive art are quite capable of making such judgements. It is, of course, true that superiority or inferiority depends to some degree on the type of workpiece and the abrading conditions employed. Thus, for an ultimate determination of relative "superiority" and "inferiority" for two types of abrasive grain, coated abrasive products made with each of the two types should be tested under the specific grinding conditions of interest, using workpieces of the type to be abraded. For the present most commercially significant abrading operations, however, it has been found that a test involving the abrasion of cold rolled steel with coated abrasive products having only one specific type of abrasive grain bonded to the backing will, when compared to an identical construction involving a different abrasive grain, yield test results that are highly reliable in categorizing abrasive grain as to relative superiority or inferiority. This test will now be described in more detail.

A pre-weighed cold rolled steel workpiece (SAE 1018) 1 inch×2 inches×7¼ inches (approximately 2.5×5×18 cm), mounted in a holder, is positioned vertically with the 1-inch×7¼ inch (2.5-cm×18-cm) face confronting a 14-inch (approximately 36-cm) diameter 65 Shore A durometer serrated rubber contact wheel over which is entrained a Grade 50 belt to be tested. The workpiece is then reciprocated vertically through a 7¼-inch (18-cm) path at the rate of 20 cycles per minute, while a spring-loaded plunger urges the workpiece against the belt with a force of 25 lbs (11.3 kg) as the belt is driven at 5500 surface feet (about 1675 meters) per minute. After one minute elapsed grinding time, the workpiece is pulled away from the moving belt, the first workpiece-holder assembly removed and reweighed, the amount of stock removed calculated by subtracting the abraded weight from the original weight, and a new pre-weighed workpiece and holder mounted on the equipment. Using four workpieces, this procedure is repeated for a total of 88 minutes or until the cut per minute is 25 grams or less, whichever occurs sooner. With coarser or finer grades of mineral, abrading force may be respectively increased or decreased and final cut figures likewise adjusted.

Because there is inevitably some variation among presumably identical belts and presumably identical workpieces, the total cut values are considered accurate to ±5%; thus, if a belt from one lot cuts at least 10% more than a belt from another lot, the first belt is deemed "superior" and the second "inferior". As might be expected, a higher degree of reliability is achieved if duplicate belts are tested.

Using the test procedure just described, the total cut values tabulated below were obtained for a series of belts made to ANSI standard using solely the type of coated abrasive mineral indicated, applying the mineral in a single step. In each case, the cut figure is the average of at least two belts.

| Mineral Designation | Type of Grade 50 Mineral | Time, Minutes | Total Cut, Grams |
|---|---|---|---|
| AO | Conventional fused alumina | 56 | 2779 |
| AZ | Co-fused alumina-zirconia | 56 | 4580 |
| CUB | Dense synthetic modified mineral alpha alumina ceramic containing approximately 7% magnesia* | 88 | 8094 |
| HT | Heat-treated fused alumina | — | — |

*Numerous other "superior" modified alpha alumina ceramic minerals are disclosed in U.S. Pat. No. 4,314,827 (the disclosure of which is incorporated herein by reference) as well as in various other patents, e.g. Canadian Patent No. 1,195,848 and U.S. Pat. No. 4,574,003, all of which would be useful as "superior" minerals in the practice of this invention.

The mineral designations listed above will be used in the following description and examples. It will be appreciated, of course, that this list of minerals is far from exhaustive and is not to be regarded as limiting the invention.

EXAMPLES 1-5

Each of the following examples was prepared using a conventional cloth backing, viz., rayon drills saturated with a blend of synthetic rubber latex and phenolic resin. A conventional calcium carbonate-filled phenol-formaldehyde make coat was applied in an amount approximately 25% greater than standard. Half of the mineral was drop coated onto the make coat and the other half electrostatically coated. The make coat was then precured, and a conventional calcium carbonate-filled size coat applied in an amount approximately 25% less than standard, after which both make and size coats were final cured. The finished product thus utilized standard amounts of bonding adhesive and a combination of abrasive grains that had the particles size distribution specified for ANSI Grade 50. The drop coated first layer of abrasive grain contained substantially only the fine and control fractions of conventional fused alumina (AO), while the electrostatically coated second layer of abrasive grain was applied as a blend of minerals containing, in an amount sufficient to provide the appropriate coarse fraction for the two mineral layers combined, a specified percentage of a mineral superior to fused alumina.

Endless belts 3 inches (7.6 cm) wide × 132 inches (335 cm) long were prepared from both conventional coated abrasive material and coated abrasive material made in accordance with the experimental examples. These belts were then entrained over a 20-inch (51-cm) diameter 65 Shore D durometer rubber contact wheel, serrated at a 45° angle to the lateral surfaces of the wheel, lands being ¾ inch (approximately 19 mm) wide and grooves one-third that dimension. The belts were then driven at 7380 surface feet (2250 meters) per minute while sets of pre-weighed metal test bars having either a rectangular or a circular cross section (approximate area 0.5–1 in$^2$, or about 3.2–6.4 cm$^2$) were urged against the belt under a pressure of either 100 or 150 psi (690 or 1035 kPa). Sets of 15 pre-weighed bars of SAE 1095 steel, 1018 steel, and 304 stainless steel were employed, while sets of 10 pre-weighed bars of Waspalloy and Inconel 600 were employed. Each bar was run for 5 seconds. Total cut figures are tabulated below:

TABLE I

| Example | First Mineral Coat | Second Mineral Coat | Total Cut, Grams, for Grade 50 Coated Abrasive Product Indicated: 1095 Steel 100 psi | 1095 Steel 150 psi | 1018 Steel 100 psi | 1018 Steel 150 psi | 304 Stainless Steel 100 psi | 304 Stainless Steel 150 psi | Waspalloy 100 psi | Waspalloy 150 psi | Inconel 600 100 psi | Inconel 600 150 psi |
|---|---|---|---|---|---|---|---|---|---|---|---|---|
| Control A | Single coat full grade 50 AO | | 195 | 266 | 180 | 221 | 253 | 317 | 176 | 134 | 537 | 415 |
| Control B | Single coat full grade 50 CUB | | 342 | 468 | 355 | 397 | 358 | 570 | 389 | 325 | 767 | 671 |
| Control C | Single coat full grade 50 AZ | | 280 | 409 | 281 | 280 | 3010 | 495 | 456 | 348 | 699 | 566 |
| Control D | Single coat full grade 50 HT | | 226 | 307 | 241 | 275 | 290 | 389 | — | — | — | — |
| Control E | Full grade 50 AO | Full grade 50 CUB | 325 | 432 | 279 | 394 | 453 | 603 | — | — | — | — |
| Control F | Full grade 50 AO | Full grade 50 AZ | 285 | 414 | 277 | 344 | 407 | 523 | — | — | — | — |
| 1 | Fine & control grade 50 AO | 90:10 fine & control grade 50 AO:full grade 40 CUB | 221 | 341 | 231 | 276 | 266 | 369 | 242 | — | 650 | — |
| 2 | Fine & control grade 50 AO | 80:20 fine & control grade 50 AO:full grade 40 CUB | 292 | 388 | 324 | 345 | 318 | 433 | 266 | — | 696 | — |
| 3 | Fine & control grade 50 AO | 80:20 fine & control grade 50 AO:full grade 40 AZ | 253 | 368 | 254 | 258 | 374 | 501 | 440 | — | 510 | — |
| 4 | Fine & control grade 50 AO | 80:20 fine & control grade 50 CUB:full grade 40 CUB | 348 | 510 | 360 | 451 | 422 | 609 | 454 | — | 727 | — |
| 5 | Fine & control grade 50 AO | 80:20 fine & control grade 50 AZ:full grade 40 AZ | 337 | 440 | 296 | 347 | 374 | 501 | — | — | — | — |

In the preceding table, all mineral ratios are by weight. The densities of AO, CUB and HT are substantially the same, so the weight ratios and volume ratios are essentially the same. Because AZ has a considerably higher density, it would theoretically be necessary to employ a higher weight to arrive at 10% volume concentration; practically, however, the comparatively small amount of AZ present does not justify such an adjustment.

Example 1 contains 5% CUB based on the total weight of mineral present. Similarly, Examples 2–5 contain 10% "superior" mineral based onthe total weight of mineral present. While it might be supposed that the overgrade fraction present in the full grade of the Grade 40 mineral would be excessively coarse for use in Grade 50, such is not the case in actual practice. There is considerable overlap in these two grades, but, as in normal manufacturing procedures, pre-coating screening removes any particles—perhaps 1%—that are larger than ANSI standards permit for Grade 50 products.

It will be observed that the performance of Examples 1–5 is significantly better than would be predicted from a linear interpolation between Control A and Controls B, C and D (as appropriate) based on the percentage of "superior" mineral present.

EXAMPLES 6 AND 7

For these two examples a nylon sateen cloth backing was saturated with a blend of synthetic rubber latex and phenolic resin to provide a backing useful in the manufacture of coated abrasive belts. Proceeding as in Examples 1–5, a calcium carbonate-filled phenolic resin make coat was applied to the backing, after which abrasive grains were applied in two separate layers, the make coat precured, a size coat applied and both make and size coats final cured. Controls were made on the same backing. Test conditions were essentially the same as described in connection with the test for categorizing abrasive grain as to relative superiority, certain adjustments being made because of the difference in grain size. Additionally, five workpieces were used instead of four. In Examples 6, the workpiece was urged against the Grade 40 coated abrasive belt with a force of 30 lbs. while in Example 7 the force of the workpiece against the Grade 60 belt was 20 lbs. The test of the Grade 40 belt and its control was terminated after 85 minutes, while the test for the Grade 60 belt and its control was terminated after a total stock removal in one pass has decreased to 80 grams or less.

For the belts of both Examples 6 and 7, half of the total weight of abrasive grains was drop coated in a first layer; this layer consisted of the fine and control fractions of AO mineral of the nominal grade, the other half of the abrasive grain was electrostatically coated in a second layer, which consisted of an 80:20 blend of (fine and control fractions of CUB in the nominal grade):(full grade CUB of the next coarser grade). Considered as a whole, the particle size of the abrasive grain conformed to that of their respective controls.

In the control belts for both Examples 6 and 7 the abrasive grain was CUB applied in a single coat in accordance with commercially available products.

TABLE II

| Example | Nominal Grade | Cut, Grams Initial | Final | Total |
|---|---|---|---|---|
| Control G | 40 | 182 | 85 | 9,313 |
| 6 | 40 | 292 | 135 | 14,736 |
| Control H | 60 | 107 | 79 | 5,382 |
| 7 | 60 | 126 | 77 | 7,144 |

It will be noted that in each case the experimental belts, which contained only half as much CUB as the controls, removed substantially more stock. Example 6 is especially impressive, since it was still cutting at a much faster rate than the control when the test was terminated.

EXAMPLES 8 AND 9

For these two examples, a polyester sateen cloth was saturated with rubber latex and synthetic resin as in previous examples. Proceeding as in previous examples, a calcium carbonate-filled phenolic make coat was applied to the backing, after which abrasive grain was applied in two seperate layers, the make coat precured, a size coat applied, and both make and size coats final cured. Controls were made on th same backing. Test conditions were essentially the same as those described in connection with the test for categorizing abrasive grain as to relative superiority except that a force of 30 lbs was employed and the test was terminated after 60 minutes. Results are tabulated below:

TABLE III

| Example | First Mineral Coat | Second Mineral Coat | Cut, Grams Initial | Final | Total |
|---|---|---|---|---|---|
| Control I | Single coat full grade 50 AZ | | 121 | 17 | 5,162 |
| Control J | Single coat full grade 50 CUB | | 137 | 72 | 6,755 |
| Control K | Full grade 50 AO | Full grade 50 AZ | 134 | 20 | 5,716 |
| Control L | Full grade 50 AO | Full grade 50 CUB | 142 | 72 | 6,849 |
| 8 | Fine & control grade 50 AO | 70:30 (fine and control grade 50 HT):(overgrade 50 CUB) | 130 | 79 | 6,533 |
| 9 | Fine & control grade 50 AO | 70:30 (fine and control grade 50 CUB):(overgrade 50 CUB) | 143 | 85 | 6,964 |

Example 8, which incorporates in the outermost layer two minerals that are superior to the AO in the first layer, removed nearly as much stock as either Control I or Control L, albeit with much less CUB; further, Example 8 retained its cutting ability better than either Control I or Control L. Example 9, which employs the same amount of CUB mineral as Control L, removed somewhat more stock and was cutting at a higher rate when the test was terminated, showing the desirability of incorporating the entire overgrade fraction in the outermost coat.

The preceding examples have all been related to the manufacture of coated abrasive belts. The same principles and general types of construction are also applicable to the manufacture of coated abrasive discs made on 30-mil (about 0.75-mm) vulcanized fiber backing. The following examples are all Grade 50 products, made to conventional coating standards, with all components being conventional except for the mineral or mineral blend employed.

EXAMPLE 10

A cured 7-inch (17.8-cm) diameter disc was first conventionally flexed to controllably crack the hard bonding resins, mounted on a beveled aluminum back-up pad, and used to grind the face of a 1-inch (2.5-cm)×7¼-inch (18.4-cm) 1.25-cm×30-cm 1018 cold rolled steel workpiece. The disc was driven at 5000 rpm while the portion of the disc overlying the beveled edge of the back-up pad contacted the workpiece with a force of 10 lbs (4.5 kg) or 15 lbs (6.8 kg), generating a disc wear path of 18.9 $in^2$ (about 120 $cm^2$). The disc was used to grind 10 separate workpieces for 1 minute each, the cumulative cut figures being tabulated below:

TABLE IV

| Example | Grade 50 Mineral | Total Cut, Grams 10 lbs. | 15 lbs. |
|---|---|---|---|
| Control M | Full grade 50 AO | 114 | 176 |
| Control N | Full grade 50 CUB | 394 | 535 |
| 10 | 2-layer - ½ full grade 50 AO followed by ½ (90:10 fine & control grade 50 AO:full grade 40 CUB) | 262 | 360 |

Once again it is noted that the abrading effectiveness of the examples is significantly greater than could have been predicted from a linear interpolation between Controls M and N.

EXAMPLES 11 & 12

Cured 7-inch (17.8-cm) diameter Grade 40 discs were prepared using different combinations of abrasive grains and tested under a 15-lb (6.8-kg) load in substantially the same manner as in Example 8, but using 12½ inch (1.27 cm) wide SAE 4150 steel workpieces. Results are tabulated below:

TABLE V

| Example | Grade 40 Mineral | Total Cut, Percent |
|---|---|---|
| Control O | Full grade 40 AO, single coat | 29 |
| Control P | Full grade 40 CUB, single coat | 100 |
| 11 | 2-layer - ½ (fine & control grade 40 AO) followed by ½ (80:20 fine and control grade 40 AO:full grade 36 CUB) | 84 |

TABLE V-continued

| Example | Grade 40 Mineral | Total Cut, Percent |
|---|---|---|
| 12 | 2 layers - ½ (fine & control grade 40 AO) followed by ½ (80:20 fine & control grade 40 CUB:full grade CUB 36) | 142 |

EXAMPLE 13

Grade 36 discs were prepared and tested as in Examples 11 and 12 except that 15-inch workpieces of the type employed in Example 8 were used. Results are tabulated below:

TABLE VI

| Example | Grade 36 Mineral | Cut, Grams | | |
|---|---|---|---|---|
| | | Initial | Final | Total |
| Control Q | Full grade 36 CUB single coat | 71 | 37 | 812 |
| 13 | 2 layers - ½ (fine & control grade 36 AO) followed by ½ (80:20 fine & control grade 36 CUB:full grade 30 CUB) | 77 | 55 | 1,018 |

I claim:

1. A coated abrasive product having a specified nominal grade of abrasive granules firmly adherently bonded to a sheet backing, the particle size of said granules comprising a conrol fraction, an overgrade fraction containing particles coarser than the control fraction, and a fine fraction containing particles finer than the control fraction, said granules consisting essentially of at least two types of mineral, one of said types having demonstrably superior cutting properties compared to an equivalent grade of another (inferior) type in the abrading operation for which said coated abrasive product is intended to be used, said abrasive granules being present in at least two layers, the lower layer or layers containing substantially only fine and control fractions of the inferior mineral, the outermost layer consisting essentially of (a) particles from the overgrade fraction of superior mineral, (b) particles from the fine fraction of at least one of the types of mineral, and (c) particles from the control fraction of at least one of the types of mineral.

2. The coated abrasive product of claim 1 wherein there are only two layers of mineral.

3. The coated abrasive of claim 1 wherein the inferior mineral is fused alumina.

4. The coated abrasive of claim 3 wherein the superior mineral includes alumina.

5. The coated abrasive product of claim 4 wherein the superior mineral is dense synthetic modified non-fused alpha alumina ceramic.

6. The coated abrasive product of claim 5 wherein the superior mineral contains a minor amount of magnesia.

7. The coated abrasive product of claim 4 wherein the superior mineral is co-fused alumina:zirconia.

8. The coated abrasive product of claim 1 wherein the weight of superior mineral is from about 1% to about 50% of the total weight of mineral present.

9. The coated abrasive product of claim 8 wherein the total weights of superior mineral and inferior mineral are approximately equal.

10. The coated abrasive product of claim 1 wherein the outermost layer contains particles from the fine and control fractions of the inferior mineral.

11. The coated abrasive product of claim 1 wherein the outermost layer contains particles from the fine and control fractions of the superior mineral.

12. A coated abrasive product having a specified nominal full grade of abrasive granules firmly adherently bonded to a sheet backing, the particles size of said granules ranging from coarse to fine, said granules consisting essentially of two types of alumina-based mineral, one of said types being present as a minor-portion and having demonstrably superior cutting properties to an equivalent grade of the other (inferior) type in the abrading operation for which said coated abrasive product is intended to be used, said abrasive granules being present in two layers, the lower layer containing substantially only the finer fractions of the inferior mineral, the outer layer essentially containing particles from the coarse fraction of the superior mineral.

13. The product of claim 12 wherein the inferior mineral is fused alumina and the superior mineral includes alumina.

* * * * *

UNITED STATES PATENT AND TRADEMARK OFFICE

CERTIFICATE OF CORRECTION

PATENT NO. : 4,737,163

DATED : April 12, 1988

INVENTOR(S) : Thomas W. Larkey

It is certified that error appears in the above-identified patent and that said Letters Patent is hereby corrected as shown below:

Col. 2, line 20, "3,410,506" should be -- 2,410,506 --

Col. 3, line 5, "in" should be -- and --.

Col. 6, line 8, there should be a space between "onthe".

Col. 7, TABLE III, "Single coat full grade 50 AZ" should be under the column heading "First Mineral Coat"

Col. 7, TABLE III, "Single coat full rade 50 CUB" should be under the column heading "First Mineral Coat"

Signed and Sealed this

Thirtieth Day of August, 1988

*Attest:*

DONALD J. QUIGG

*Attesting Officer*

*Commissioner of Patents and Trademarks*